US010022782B1

(12) United States Patent
Weber

(10) Patent No.: US 10,022,782 B1
(45) Date of Patent: Jul. 17, 2018

(54) ATTACHMENT FOR A RIVET SETTING TOOL

(71) Applicant: MILWAUKEE ELECTRIC TOOL CORPORATION, Brookfield, WI (US)

(72) Inventor: Andrew J. Weber, Cudahy, WI (US)

(73) Assignee: MILAWUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 15/868,153

(22) Filed: Jan. 11, 2018

Related U.S. Application Data

(60) Provisional application No. 62/445,841, filed on Jan. 13, 2017.

(51) Int. Cl.

| | |
|---|---|
| ***B21J 15/02*** | (2006.01) |
| ***B21J 15/36*** | (2006.01) |
| ***B21J 15/26*** | (2006.01) |
| ***B21J 15/10*** | (2006.01) |
| ***B21J 15/30*** | (2006.01) |
| ***B21J 15/32*** | (2006.01) |

(52) U.S. Cl.
CPC ..... *B21J 15/36* (2013.01); *B21J 15/02* (2013.01); *B21J 15/105* (2013.01); *B21J 15/26* (2013.01); *B21J 15/30* (2013.01); *B21J 15/32* (2013.01)

(58) Field of Classification Search
CPC ... B21J 15/02; B21J 15/32; B21J 15/30; B21J 15/36; B21J 15/26; B21J 15/105; A01G 3/033
USPC ..... 29/243.526
See application file for complete search history.

(56) References Cited

U.S. PATENT DOCUMENTS

| | | | | | |
|---|---|---|---|---|---|
| 2,317,224 | A * | 4/1943 | Rylander | B21J 15/30 | 29/243.54 |
| 2,365,537 | A * | 12/1944 | Fischer | B21J 15/22 | 72/443 |
| 2,714,250 | A * | 8/1955 | Twedt | A01G 3/033 | 30/180 |
| 4,263,801 | A * | 4/1981 | Gregory | B21J 15/205 | 29/243.524 |
| 5,143,216 | A * | 9/1992 | Aurtoi | B21J 15/32 | 206/303 |
| 6,000,596 | A | 12/1999 | Cariati | | |
| 8,312,756 | B2 * | 11/2012 | Swinford | B21J 15/02 | 29/243.53 |

FOREIGN PATENT DOCUMENTS

| | | |
|---|---|---|
| EP | 1297916 | 4/2003 |
| EP | 1402974 | 3/2004 |
| EP | 1525928 | 4/2005 |
| EP | 2113317 | 11/2009 |

* cited by examiner

*Primary Examiner* — David B Jones
(74) *Attorney, Agent, or Firm* — Michael Best & Friedrich LLP

(57) ABSTRACT

An attachment for a rivet setting tool with a first plurality of jaws configured to clamp and pull a mandrel of a rivet comprises a flexible sheath and a flexible cable arranged within the flexible sheath. The flexible cable includes a first end configured to be clamped and pulled by the first plurality of jaws and a second end opposite the first end. A second plurality of jaws between which the mandrel is receivable is coupled to the second end of the flexible cable. The second plurality of jaws is configured to clamp and pull the mandrel in response to the first end of the flexible cable being clamped and pulled by the first plurality of jaws.

20 Claims, 5 Drawing Sheets

ATTACHMENT FOR A RIVET SETTING TOOL

CROSS-REFERENCE TO RELATED APPLICATIONS

This application claims priority to U.S. Provisional Patent Application No. 62/445,841 filed on Jan. 13, 2017, the entire content of which is incorporated herein by reference.

FIELD OF THE INVENTION

The present invention relates to rivet setting tools, and more particularly to attachments for rivet setting tools.

BACKGROUND OF THE INVENTION

Rivet setting tools use jaws to clamp and pull a mandrel of a rivet during a rivet setting process.

SUMMARY OF THE INVENTION

The present invention provides, in one aspect, an attachment for a rivet setting tool. The rivet setting tool has a first plurality of jaws configured to clamp and pull a mandrel of a rivet. The attachment comprises a flexible sheath and a flexible cable arranged within the flexible sheath. The flexible cable includes a first end configured to be clamped and pulled by the first plurality of jaws and a second end opposite the first end. A second plurality of jaws between which the mandrel is receivable is coupled to the second end of the flexible cable. The second plurality of jaws is configured to clamp and pull the mandrel in response to the first end of the flexible cable being clamped and pulled by the first plurality of jaws.

The present invention provides, in another aspect, a rivet setting tool assembly comprising a housing, a pulling mechanism within the housing, a plurality of jaws between which a mandrel of a rivet is receivable, and a flexible cable interconnecting the pulling mechanism and the jaws. The jaws are configured to clamp and pull the mandrel in response to the flexible cable being pulled by the pulling mechanism.

The present invention provides, in yet another aspect, a rivet setting tool assembly comprising a rivet setting tool including a housing, a motor, and a pulling mechanism configured to be driven by the motor. The pulling mechanism includes a first plurality of jaws configured to clamp and pull a mandrel of a rivet in response to the motor driving the pulling mechanism. The rivet setting tool assembly further includes an attachment that is selectively attachable to the rivet setting tool. The attachment includes a flexible sheath, a flexible cable arranged within the flexible sheath, the flexible cable including a first end configured to be clamped and pulled by the first plurality of jaws and a second end opposite the first end, and a second plurality of jaws between which the mandrel is receivable and coupled to the second end of the flexible cable. The second plurality of jaws is configured to clamp and pull the mandrel in response to the first end of the flexible cable being clamped and pulled by the first plurality of jaws.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
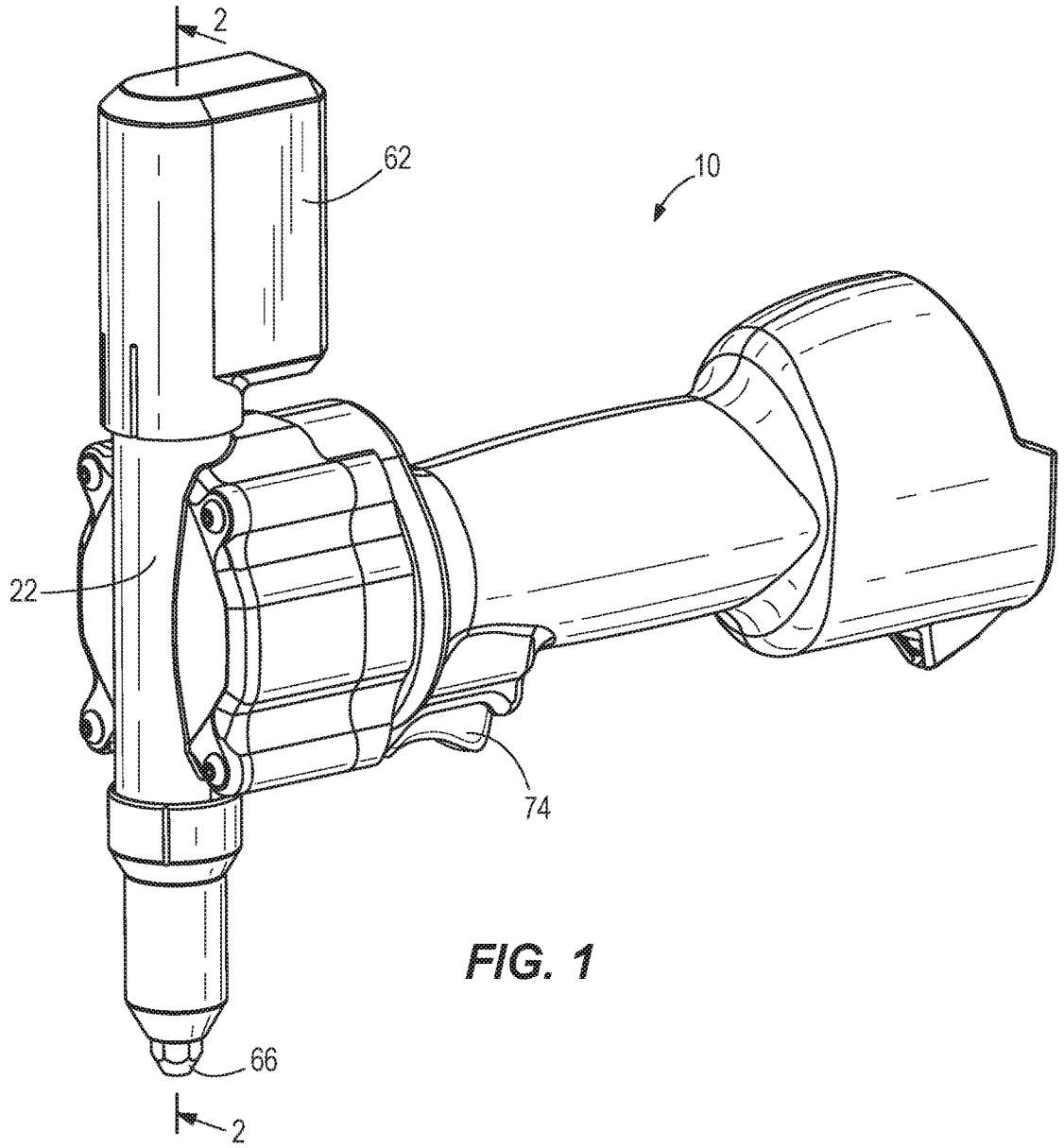
FIG. 1 is a perspective view of a rivet setting tool.
Figure 2:
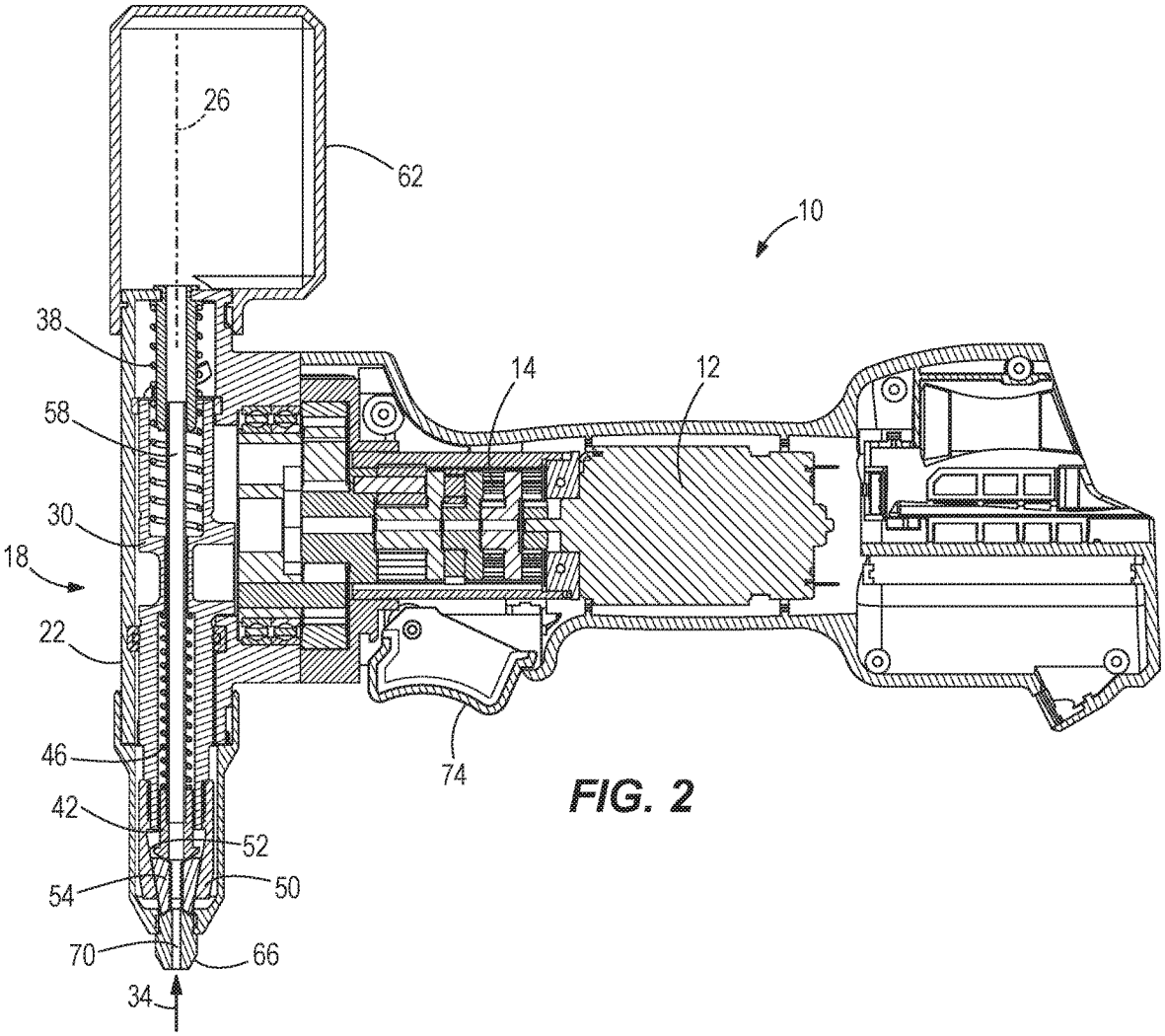
FIG. 2 is a cross-sectional view of the rivet setting tool of FIG. 1.
Figure 3:
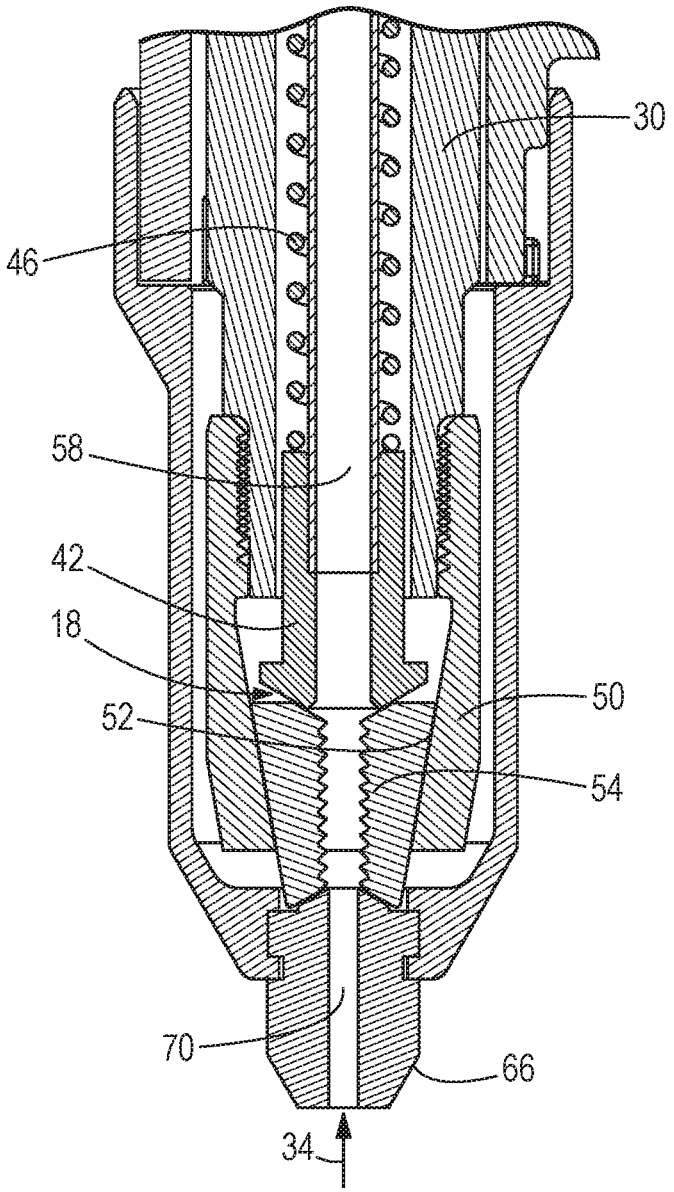
FIG. 3 is an enlarged view of a portion of a pulling mechanism of the rivet setting tool of FIG. 1.

With reference to FIGS. 1 and 2, a rivet setting tool 10, such as a blind rivet setting tool, includes an electric motor 12 and a transmission 14 (e.g., a multi-stage planetary transmission) that receives torque from the motor 12. The tool 10 also includes a pulling mechanism 18 that is actuated in response to activation of the motor 12 to initiate a rivet setting process. The rivet setting tool 10 may include an on-board power source (e.g., a battery, not shown) or an electrical cord (also not shown) for connection to a remote power source (e.g., an alternating current source).

With reference to FIG. 2, the tool 10 includes a housing 22 in which the pulling mechanism 18 is positioned and arranged along a longitudinal axis 26 along which a mandrel of a rivet is pulled. The pulling mechanism 18 includes a pulling head 30 biased opposite a pulling direction 34 of the mandrel by a head spring 38. The pulling mechanism 18 further includes a jaw pusher 42 within the pulling head 30 and biased opposite the pulling direction 34 by a pusher spring 46 set within the pulling head 30. A jaw sleeve 50 has a tapered interior surface 52 and is coupled to the pulling head 30 for movement therewith in the pulling direction 34.

The pulling mechanism 18 also includes a first plurality of jaws 54 set at least partially within the jaw sleeve 50 and biased opposite the pulling direction 34 by the jaw spring 46 and jaw pusher 42. A spent-mandrel tube 58 extends along the longitudinal axis 26 through the jaw pusher 42, the pusher spring 46, the pulling head 30, and the head spring 38, terminating in a mandrel container 62 to collect broken mandrels after a rivet-setting operation has been completed. A nose 66 is provided at an end of the housing 22 opposite the mandrel container 62. The nose 66 includes an opening 70 that is coaxial with the spent-mandrel tube 58 and permits an operator to insert a mandrel of the rivet through the nose 66 and between the jaws 54 in a position where the mandrel can be clamped. The nose 66 may be one of a plurality of different noses 66, which may be interchangeably used with the rivet setting tool 10, having different size openings 70 to accommodate different size rivets.

In operation, an operator inserts a mandrel through the opening 70 of the nose 66 and between the jaws 54. An operator then activates the motor 12 by pulling a trigger 74 on the tool 10, which causes the transmission 14 to retract the pulling head 30, moving it against the biasing force of the head spring 38 along the longitudinal axis 26 and away from the nose 66. The jaw sleeve 50 is also drawn in the pulling direction 34 in unison with the pulling head 30.

Because the interior surface 52 of the jaw sleeve 50 is tapered inward, in response to movement of the jaw sleeve 50 in the pulling direction 34, the jaws 54 and are displaced toward the axis 26 as they slide along the tapered interior surface 52, clamping onto the mandrel of the rivet. As the pulling head 30 and jaw sleeve 50 continue to move in the pulling direction 34, the rivet is eventually set and the mandrel is severed. The broken mandrel is now free to slide through the spent-mandrel tube 58 for collection in the mandrel container 62.

In some instances, the operator is prevented from setting a rivet in a hard-to-reach spot because the shape of the tool 10 prevents the operator from inserting the mandrel of the rivet into the nose 66. In these instances, an operator may use a flexible attachment 78 (FIG. 4) to facilitate setting rivets in locations that are otherwise inaccessible by the rivet-setting tool 10.

Figure 4:
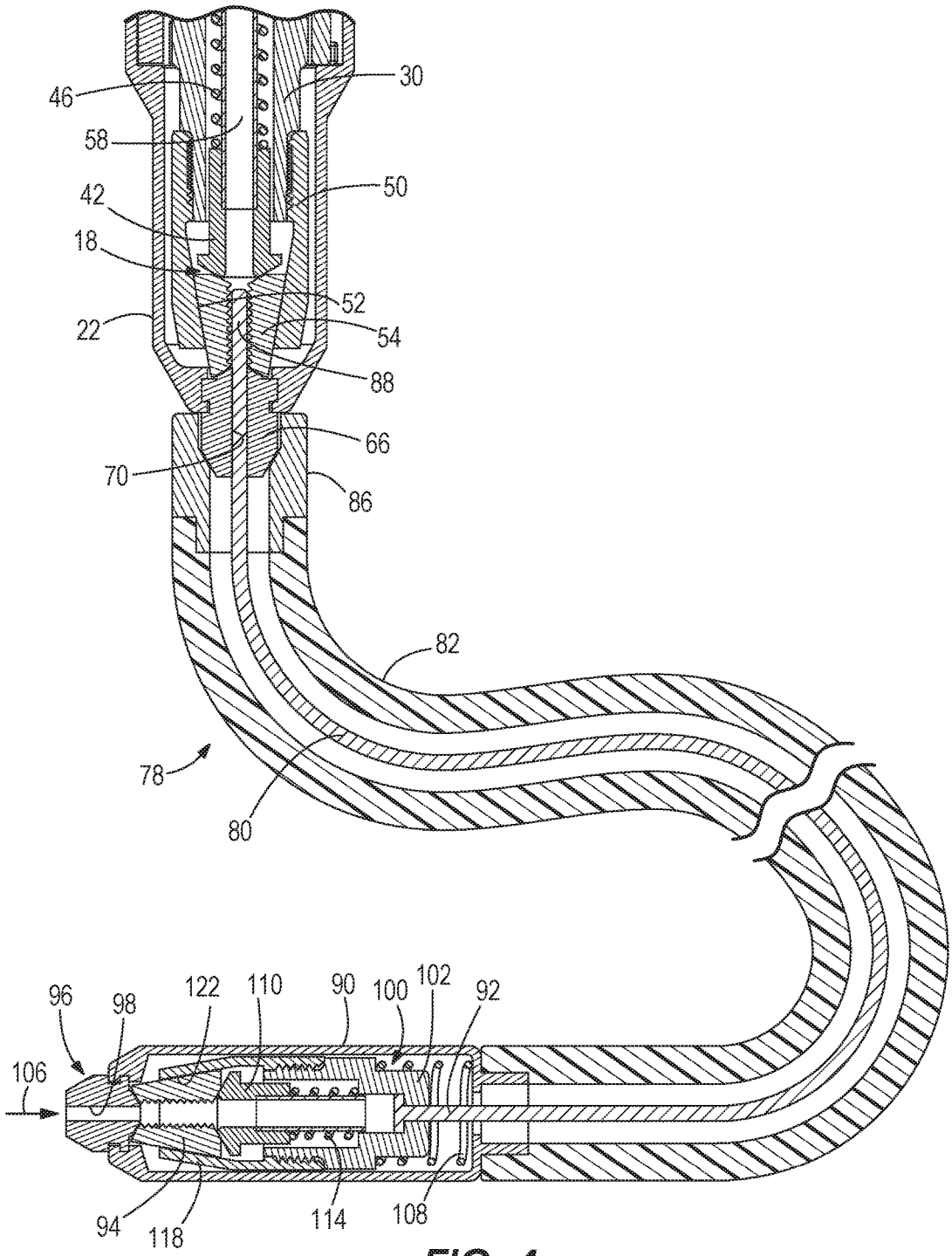
FIG. 4 is a perspective view of an attachment secured to the rivet setting tool of FIG. 1.

As shown in FIG. 4, the attachment 78 includes a flexible sheath 82 and a flexible cable 80 arranged within the flexible sheath 82. The sheath 82 may be formed of an elastic material to permit the sheath 82 to bend, but also to provide sufficient strength such that repeated bending of the sheath 82 does not cause rupture. The flexible cable 80 within the sheath 82 may be formed from intertwined strands only capable of carrying tension, or a single strand having a sufficient thickness capable of carrying a nominal compressive force without buckling, yet being sufficiently pliable to conform with the sheath 82 as it is bent.

The attachment 78 has an attachment end 86 configured to attach to the nose 66 and/or housing 22 of the rivet-setting tool 10 and a setting end 90 configured to grasp the mandrel of a rivet. The attachment 78 is flexible, so as to permit an operator to orient the setting end 90 of the attachment in a variety of awkward, otherwise inaccessible positions. Extending from the attachment end 86, a first end 88 of the flexible cable 80 has a size and shape that are similar to that of a mandrel. Because of this similarity, the first end 88 of the flexible cable 80 is receivable in the opening 70 through the nose 66 and may be clamped by the jaws 54. At the setting end 90, a second end 92 of the flexible cable 80 is configured to pull a second plurality of jaws 94 within the setting end 90, which are configured to clamp and pull the mandrel of the rivet in a manner similar to the jaws 54. Like the rivet-setting tool 10, the attachment 78 includes a nose 96, which has an opening 98 through which the mandrel is receivable, at the setting end 90 adjacent the jaws 94. The nose 96 may be one of a plurality of different noses 96, which may be interchangeably used with the attachment 78, having different size openings 98 to accommodate different size rivets.

For example, in the embodiment illustrated in FIG. 4, the setting end 90 includes a pulling mechanism 100 that is similar to the pulling mechanism 18. The pulling mechanism 100 includes a pulling head 102 biased opposite a second pulling direction 106 of the mandrel by a head spring 108. The pulling mechanism 100 further includes a jaw pusher 110 within the pulling head 102 and biased opposite the second pulling direction 106 by a pusher spring 114 set within the pulling head 102. A jaw sleeve 118 with a tapered inner edge 122 is coupled to the pulling head 102 for movement therewith in the second pulling direction 106. In the illustrated embodiment, the second end 92 of the flexible cable 80 is coupled to the pulling head 102.

To secure the attachment 78 to the rivet setting tool 10, an operator feeds the first end 88 of the cable 80 through the opening 70 in the nose 66 and attaches the attachment end 86 to the nose 66 of the rivet setting tool 10, at which time the first end 88 of the flexible cable 80 is properly positioned between the jaws 54. In the embodiment illustrated in FIG. 4, the attachment end 86 is attached to the nose 66 but the attachment end 86 could alternatively be attached to the housing 22. The operator then bends the sheath 82 in a manner necessary to access the rivet and positions the setting end 90 of the attachment 78 over the mandrel of the rivet, making sure the mandrel is positioned between the second plurality of jaws 94 within the setting end 90.

An operator then activates the motor 12 by depressing the trigger 74. Instead of clamping and pulling the mandrel of a rivet, the jaws 54 clamp and pull the first end 88 of the flexible cable 80. This creates tension in the flexible cable 80, causing it to slide within the sheath 82 and causing the second end 92 of the flexible cable 80 to pull the pulling head 102 in the second pulling direction 106. Once the pulling head 102 is pulled in the second pulling direction 106 by the second end 92, the jaws 94 in the setting end 90 clamp onto and pull the mandrel of the rivet until it sets and the mandrel is severed in the same manner as described above with the pulling mechanism 18 and jaws 54.

Figure 5:
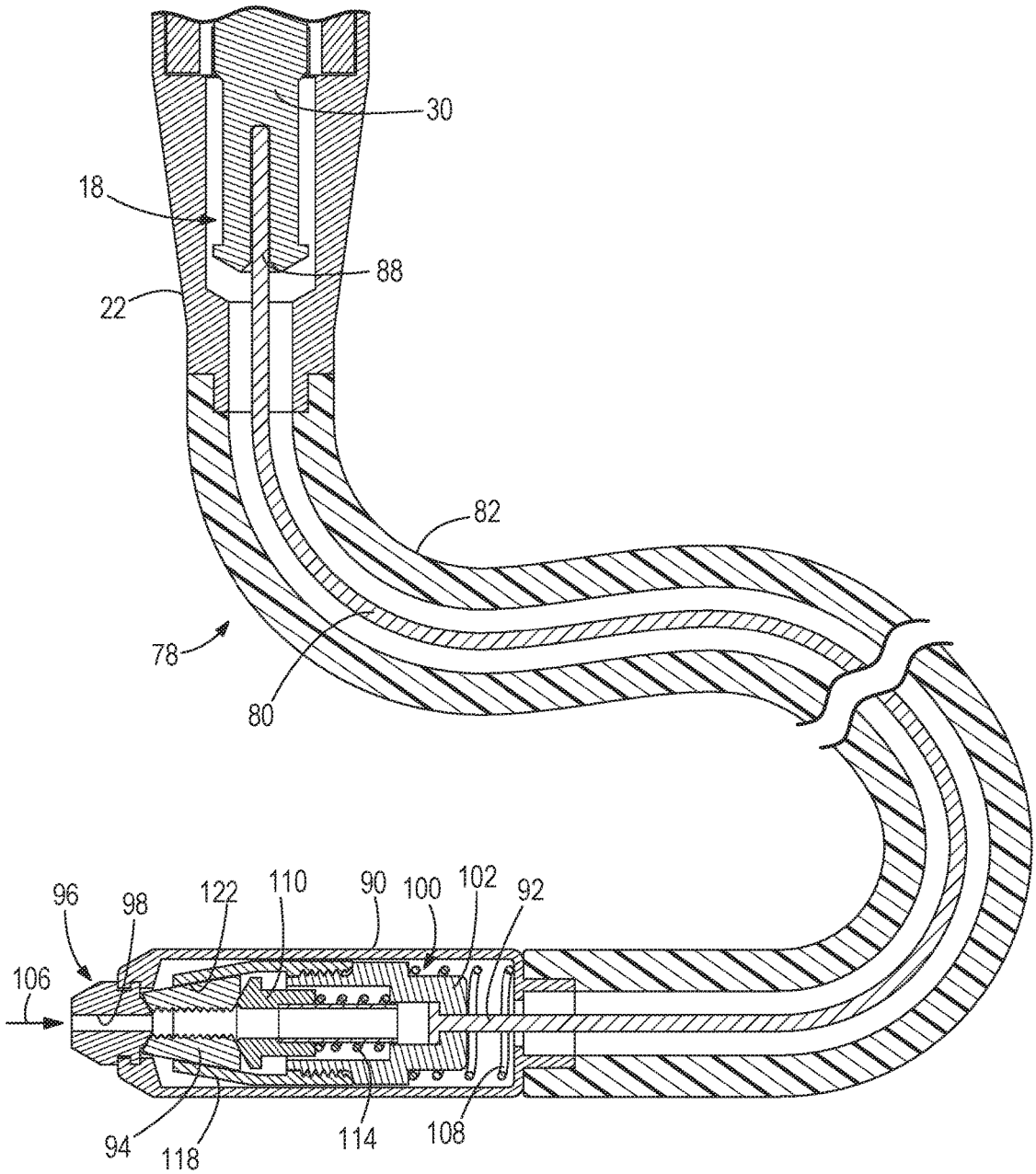
FIG. 5 is cross-sectional view of a rivet setting tool assembly.

In an alternative embodiment shown in FIG. 5, the attachment 78 may be permanently incorporated with the rivet setting tool 10, with the jaw pusher 42, pusher spring 46, jaw sleeve 50, jaws 54, spent mandrel tube 58, and nose 66 omitted, and with the first end 88 of the flexible cable 80 directly attached to the output of the pulling mechanism 18 (e.g., the pulling head 30).

Various features of the invention are set forth in the following claims.

What is claimed is:

1. An attachment for a rivet setting tool, the rivet setting tool having a first plurality of jaws configured to clamp and pull a mandrel of a rivet, the attachment comprising:

a flexible sheath;

a flexible cable arranged within the flexible sheath, the flexible cable including a first end configured to be clamped and pulled by the first plurality of jaws, and a second end opposite the first end; and a second plurality of jaws between which the mandrel is receivable and coupled to the second end of the flexible cable, and wherein the second plurality of jaws is configured to clamp and pull the mandrel in response to the first end of the flexible cable being clamped and pulled by the first plurality of jaws.

2. The attachment of claim 1, further comprising an attachment end configured to selectively attach the attachment to the rivet setting tool, and wherein the first end of the cable extends from the attachment end.

3. The attachment of claim 2, further comprising a setting end opposite the attachment end and configured to receive the mandrel, and wherein the second plurality of jaws is arranged within the setting end.

4. The attachment of claim 3, wherein the flexible sheath extends between the attachment end and the setting end.

5. The attachment of claim 3, further comprising a nose on the setting end of the attachment, wherein the nose includes an opening through which the mandrel is receivable for clamping by the second plurality of jaws.

6. The attachment of claim 5, further comprising:

a pulling head arranged within the setting end of the attachment; and a spring biasing the pulling head toward the nose, wherein the second end of the flexible cable is attached to the pulling head, and wherein the spring is compressed in response to the first end of the flexible cable being clamped and pulled by the first plurality of jaws.

7. The attachment of claim 6, further comprising:

a jaw sleeve having a tapered interior surface and coupled for movement with the pulling head, the second plurality of jaws located within the jaw sleeve; and a jaw pusher biased by a pusher spring and biasing the second plurality of jaws in the direction of the nose, wherein the jaws move along the interior surface of the jaw sleeve and clamp onto the mandrel in response to the first end of the flexible cable being clamped and pulled by the first plurality of jaws.

8. A rivet setting tool assembly comprising:

a housing;

a pulling mechanism within the housing;

a plurality of jaws between which a mandrel of a rivet is receivable; and a flexible cable interconnecting the pulling mechanism and the jaws, and wherein the jaws are configured to clamp and pull the mandrel in response to the flexible cable being pulled by the pulling mechanism.

9. The rivet setting tool assembly of claim 8, further comprising a flexible sheath in which the flexible cable is received.

10. The rivet setting tool assembly of claim 9, wherein the flexible sheath includes a setting end configured to receive the mandrel, and wherein the plurality of jaws is arranged within the setting end.

11. The rivet setting tool assembly of claim 10, wherein the flexible sheath includes an attachment end opposite the setting end and coupling the flexible sheath to the housing.

12. The rivet setting tool assembly of claim 11, further comprising a nose on the setting end, wherein the nose includes an opening through which the mandrel is receivable for clamping by the plurality of jaws.

13. The rivet setting tool assembly of claim 12, further comprising:

a pulling head arranged within the setting end; and a spring biasing the pulling head toward the nose, wherein a first end of the flexible cable is coupled to the pulling mechanism and a second end of the flexible cable is coupled to the pulling head, and wherein the spring is compressed in response to the first end of the flexible cable being pulled by the pulling mechanism.

14. The rivet setting tool assembly of claim 13, further comprising:

a jaw sleeve having a tapered interior surface and coupled for movement with the pulling head, the plurality of jaws located within the jaw sleeve; and a jaw pusher biased by a pusher spring and biasing the plurality of jaws in the direction of the nose, wherein the jaws move along the interior surface of the jaw sleeve and clamp onto the mandrel in response to the first end of the flexible cable being clamped and pulled by the first plurality of jaws.

15. A rivet setting tool assembly comprising:

a rivet setting tool including a housing, a motor, and a pulling mechanism configured to be driven by the motor, the pulling mechanism including a first plurality of jaws configured to clamp and pull a mandrel of a rivet in response to the motor driving the pulling mechanism; and an attachment that is selectively attachable to the rivet setting tool, the attachment including a flexible sheath, and a flexible cable arranged within the flexible sheath, the flexible cable including a first end configured to be clamped and pulled by the first plurality of jaws, and a second end opposite the first end, and a second plurality of jaws between which the mandrel is receivable and coupled to the second end of the flexible cable, wherein the second plurality of jaws is configured to clamp and pull the mandrel in response to the first end of the flexible cable being clamped and pulled by the first plurality of jaws.

16. The rivet setting tool assembly of claim 15, wherein the flexible sheath includes an attachment end configured to selectively attach the attachment to the rivet setting tool, and wherein the first end of the cable extends from the attachment end.

17. The rivet setting tool assembly of claim 16, wherein the flexible sheath includes a setting end opposite the attachment end and configured to receive the mandrel, and wherein the second plurality of jaws is arranged within the setting end.

18. The rivet setting tool assembly of claim 17, wherein the flexible sheath extends between the attachment end and the setting end.

19. The rivet setting tool assembly of claim 18, further comprising a nose on the setting end, wherein the nose includes an opening through which the mandrel is receivable for clamping by the second plurality of jaws.

20. The rivet setting tool assembly of claim 19, further comprising:

a pulling head arranged within the setting end of the attachment;

a spring biasing the pulling head toward the nose;

a jaw sleeve having a tapered interior surface and coupled for movement with the pulling head, the second plurality of jaws located within the jaw sleeve; and a jaw pusher biased by a pusher spring and biasing the second plurality of jaws in the direction of the nose, wherein the second end of the flexible cable is attached to the pulling head, and wherein the spring is compressed and the jaws move along the interior surface of the jaw sleeve and clamp onto the mandrel in response to the first end of the flexible cable being clamped and pulled by the first plurality of jaws.

* * * * *